United States Patent [19]

Foresman

[11] 4,391,427

[45] Jul. 5, 1983

[54] HOLDER FOR A BAR OF SOAP

[76] Inventor: Samuel U. Foresman, 672 92nd Ave., North, Naples, Fla. 33940

[21] Appl. No.: 212,819

[22] Filed: Dec. 4, 1980

[51] Int. Cl.[3] ..... F16M 11/00

[52] U.S. Cl. ..... 248/176; 248/127

[58] Field of Search ..... 248/176, 127, 309 R, 248/604, 1, 431; 34/239; 46/46, 47

[56] References Cited

U.S. PATENT DOCUMENTS

| | | | |
|---|---|---|---|
| 518,581 | 4/1894 | Bartlett | 248/431 X |
| 2,235,283 | 3/1941 | Carver | 248/176 X |
| 2,366,421 | 1/1945 | Nelson | 248/127 |
| 2,475,500 | 7/1949 | Heliote | 248/176 |
| 2,606,393 | 8/1952 | Fleming | 248/127 |
| 2,642,603 | 6/1953 | Mills | 248/309 R X |
| 3,067,975 | 12/1962 | Wilcox | 248/1 |

FOREIGN PATENT DOCUMENTS

| | | | |
|---|---|---|---|
| 603758 | 1/1926 | France | 248/176 |
| 879692 | 11/1942 | France | 248/176 |

*Primary Examiner*—Victor N. Sakran
*Assistant Examiner*—Sarah A. Lechok

[57] ABSTRACT

A holder for a bar of soap which permits rapid drying of the entire surface of a wet bar of soap, said holder having a base, four supports mounted on the base with each support having a notch at its upper extremity and the four notches forming the four corners of a horizontal rectangle, and a flexible endless cord supported by said four notches and forming a horizontal Roman numeral ten or "X", said "X" shaped endless cord forming a horizontal soap bar supporting member of small surface area.

4 Claims, 4 Drawing Figures

HOLDER FOR A BAR OF SOAP

BRIEF SUMMARY OF THE INVENTION

I have never been satisfied with the available dishes and other means for holding a bar of soap after using the bar for washing or bathing. If the bar of soap (hereinafter sometimes referred to as "the soap") is placed on a countertop or in the slightly dished oval area often provided at the edge of the wash basin of many bathroom fixtures, the water draining from the soap not only dissolves away some of the soap but also creates a gooey residue beneath the bar of soap which causes the bar to stick to the countertop leaving an unsightly and wasteful mess to be repeatedly cleaned up.

Most soap dishes attempt to reduce this waste of soap and unsightly mess by including two or more raised ridges in the bottom of the soap dish but these ridges soon become embedded in soap residue. Moreover, when a bar of wet soap is put into a dish, usually by a dripping hand, water is deposited on the bottom of the dish and air cannot freely circulate about the bar of soap due both to the confining nature of the dish itself and also the film of water often present on the bottom of the dish.

The dual problems of wasting soap and soap dishes accumulating unsightly and annoying soap residue are particularly acute with the recently popular beauty cream-filled soaps which dissolve much more rapidly while in contact with water and hence tend to lose much soap in the drying process between uses.

My invention, a radically new holder for a bar of soap, prevents dripping from and dissolving of a wet bar of soap placed upon my soap holder. By permitting free circulation of air and exposure to the air of the entire surface of the bar of soap, the soap does not drip and it dries much more rapidly. In addition, my design permits unobstructed placing of the soap onto my holder and the unobstructed grasping of the soap by a human hand wishing to use the soap.

Briefly stated, my holder for a bar of soap is supported by a base which may take many forms but in a preferred embodiment is a slab of marble or other decorative material with flat horizontal upper and lower surfaces. Four vertical supports preferably cylindrical posts are mounted on the base with each support having a notch at its upper extremity, the four notches forming the four corners of a horizontal rectangle. A flexible endless cord, which may be a colorless nylon filament, a stainless steel wire or a common rubber band, is stretched over the four supports to lodge in and be supported by the four notches of the supports so that the endless cord lies like a Roman numeral ten along two sides of the rectangle and along the two lines joining the two notches most remote from each other. The endless cord thus forms an "X" shaped horizontal soap-supporting member of small surface area.

While the holder may take various forms, the essence of my invention is a freely supported endless cord in the form of a horizontal Roman numeral ten for supporting a bar of wet soap thus exposing to the air the entire surface of the bar of soap.

DETAILED DESCRIPTION

Figure 1:
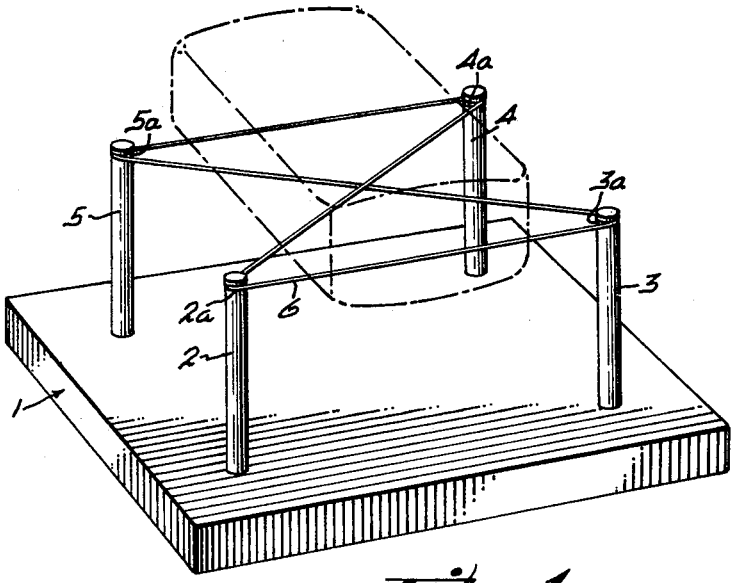
FIG. 1 is a view in perspective showing a preferred form of my soap bar holder with a bar of soap shown in broken lines resting on my holder.
Figure 2:
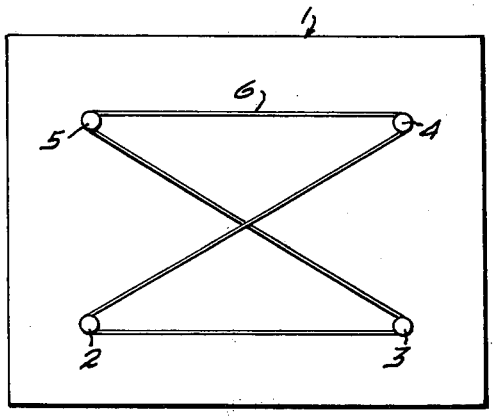
FIG. 2 is an elevational view from above showing the soap bar holder of FIG. 1.
Figure 3:
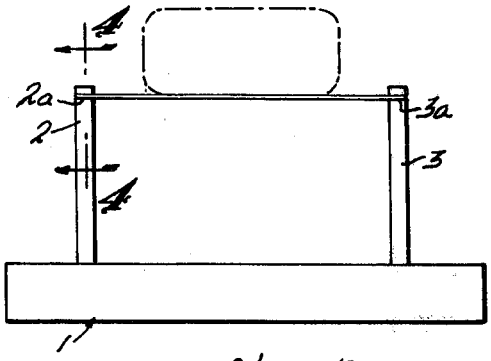
FIG. 3 is a front side view of the soap bar holder of FIG. 1.

FIG. 1 shows a preferred form of my soap bar holder. The base of the holder may vary widely in its form but base 1 as shown is a slab of marble three quarters of an inch thick, 4½ inches long and 3 inches wide to provide a solid and attractive appearance.

Four identical cylindrical posts or supports 2, 3, 4 and 5 are mounted on base 1. Supports 2, 3, 4 and 5 as shown are made of stainless steel to provide a decorative and rust-free appearance, but other materials and forms of supports may be used. The important feature is that each of the four supports have in its upper extremity a notch, such as notches *2a, 3a, 4a* and *5a* shown in posts or supports 2, 3, 4 and 5, which four notches form the four corners of a horizontal rectangle.

The notches *2a, 3a, 4a* and *5a* are ring-shaped grooves in the outer surfaces of posts or supports 2, 3, 4 and 5 respectively, but other forms of notches may be used depending upon the form on the supports used. However, the notches must form the four corners of a horizontal rectangle.

Figure 4:
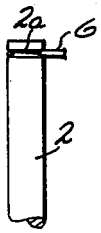
FIG. 4 is a partially broken away view taken along the line 4—4 indicated in FIG. 3 showing a detail of the notched support and the endless cord supported in the notch.

As the support or holder for the bar of soap, an endless cord 6 as shown in FIGS. 1, 2, 3 and 4 is stretched over the upper extremities of supports 2, 3, 4 and 5 and lodged in the four notches *2a, 3a, 4a* and *5a* as best shown FIG. 4, forming the cord 6 into a horizontal "X" or more accurately a Roman numeral ten.

Cord 6 may be made of many different materials such as stainless steel or other rust resistant metal wire, water repellant elastic material such as a common rubber band, or preferably a colorless plastic such as monofilament nylon. It is immaterial whether the cord is actually endless like a rubber band or formed into an endless loop by tying a secure knot in a thirty pound test nylon monofilament fishing line.

My design of a soap bar holder suspends the bar on four horizontal segments of a cord of very small surface area with almost the entire outer surface of the bar freely exposed to the air without being confined within a dish. This arrangement, I have found by experimentation, provides for almost no dripping of water and dissolved soap from the bar and much more rapid drying of the entire surface of the soap. In addition, the design permits unobstructed placing of the soap onto the holder and also unobstructed grasping of the soap by a human hand.

Other forms of the invention will be apparent from the description of my invention and the drawings, and the scope of the invention is restricted only by the following claims.

I claim:

1. A holder for a bar of soap which permits rapid drying of the entire surface of a wet bar of soap comprising a base, four supports mounted on said base, each support having a notch at its upper extremity, said four notches forming the four corners of a horizontal rectangle, and a flexible endless cord passing around and supported by said four notches, said endless cord extending along the bottom and the top of the rectangle between the bottom and the top, said endless cord thereby forming a horizontal soap bar supporting member of small surface area, which enables grasping of the soap from the sides of the rectangle without interference with the cord and which provides substantial support at the center for the soap as it becomes smaller with use.

2. A holder for a bar of soap as set forth in claim 1 wherein the base consists of a rectangular slab.

3. A holder for a bar of soap as set forth in claim 1 wherein the four supports are identical cylindrical posts having notches in the form of ring-shaped grooves.

4. A holder for a bar of soap as set forth in claim 1, 2 or 3 wherein the endless cord is made of monofilament plastic material.

* * * * *